US005244058A

United States Patent [19]

Carlson et al.

[11] Patent Number: 5,244,058

[45] Date of Patent: Sep. 14, 1993

[54] PORTABLE FENCE-SCALING STEP

[76] Inventors: Robert M. Carlson, 819 B St., Saginaw, Mich. 48602; Edmund F. Robar, 130 Channel Ct., Houghton Lake, Mich. 48629

[21] Appl. No.: 819,477

[22] Filed: Jan. 10, 1992

[51] Int. Cl.[5] ..... E06C 7/00

[52] U.S. Cl. ..... 182/92; 182/228; 182/150

[58] Field of Search ..... 182/53, 92, 90, 91, 182/228, 150; 248/214, 238

[56] References Cited

U.S. PATENT DOCUMENTS

| | | | |
|---|---|---|---|
| 2,252,025 | 8/1941 | Olson | 248/238 X |
| 2,848,150 | 8/1958 | Tans . | |
| 2,878,078 | 3/1959 | Moultrop | 182/150 |
| 3,078,955 | 2/1963 | Rich . | |
| 4,222,136 | 9/1980 | Valentino | 182/92 X |
| 4,243,121 | 1/1981 | Kiss et al. . | |
| 4,495,883 | 1/1985 | Hoy | 182/150 X |
| 4,778,032 | 10/1988 | Takahashi | 182/90 |
| 4,785,910 | 11/1988 | Tonkovich | 182/92 |
| 4,907,674 | 3/1990 | Miller | 182/92 X |
| 4,911,264 | 3/1990 | McCafferty | 182/92 |
| 5,033,583 | 7/1991 | Candelaria, Jr. | 182/92 |

*Primary Examiner*—Karen J. Chotkowski
*Attorney, Agent, or Firm*—Learman & McCulloch

[57] ABSTRACT

A portable step has a tread member to which is pivoted corresponding ends of a pair of support arms that terminate at their opposite ends in projections which extend from the arms at an acute angle thereto. The support arms are rockable to positions in which they substantially parallel one another and extend in the same direction from the tread member, thereby enabling the projections to be passed through openings in a fence or other barrier to suspend the tread member in a substantially horizontal position at an intermediate level between the top and bottom of the fence, thereby facilitating scaling of the fence by a person.

19 Claims, 1 Drawing Sheet

FIG-1
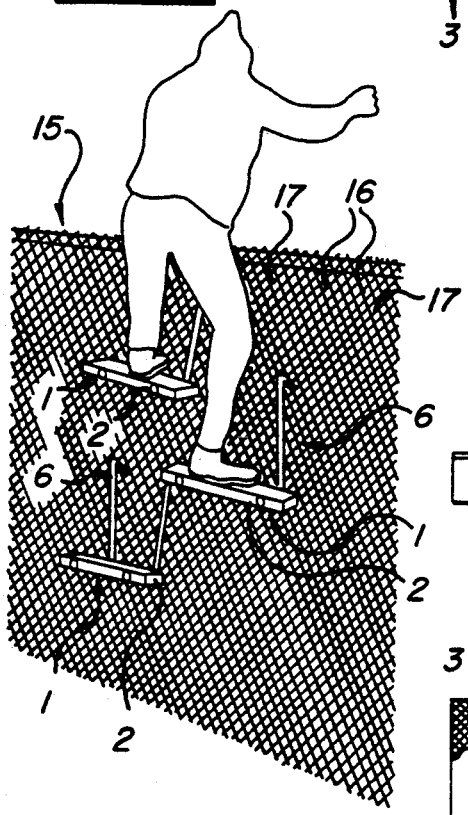
FIG-2
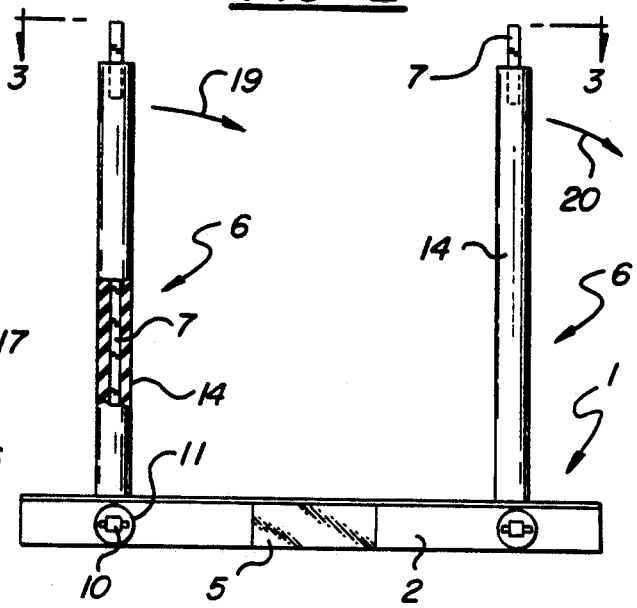
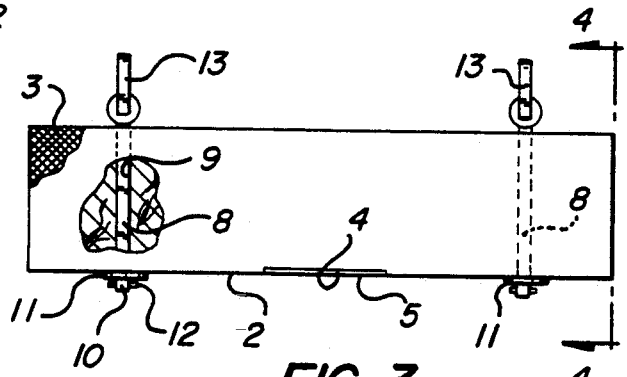
FIG-3
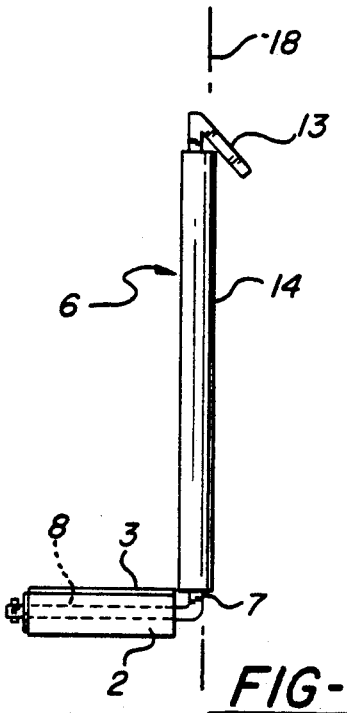
FIG-4
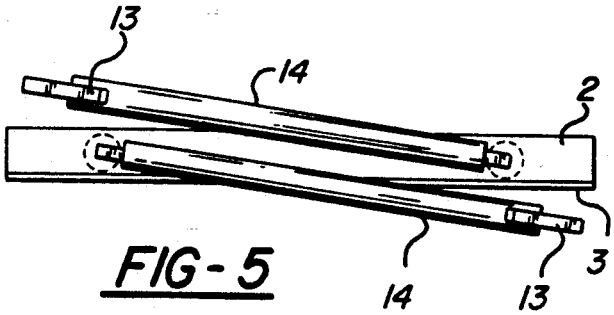
FIG-5

PORTABLE FENCE-SCALING STEP

This invention relates to a portable device that is quickly attachable to an upright fence at such level as to enable the device to serve as a step and facilitate scaling the fence.

BACKGROUND OF THE INVENTION

Police officers often conduct raids of premises where illegal activities are thought to be in progress. Such premises commonly are enclosed by upright barriers such as chain-link fences which hinder access to the premises.

When raiding suspicious premises swiftness of access thereto and quietness are essential if the element of surprise is to be achieved.

It has been proposed heretofore to use folding ladders and portable stiles to enable raiding officers to scale fences and similar barriers. However, such devices necessarily must be large and cumbersome, and commonly require substantial time to erect and position with sufficient stability to provide support for the officers who use them to traverse the barrier. In addition, the known devices frequently are noisy in operation, thereby making it possible for the occupants of the premises being raided to become forewarned of the raid.

Portable fence-scaling devices are not limited to use by law enforcement officers. They frequently can be utilized by the military, firemen, and others when it becomes necessary to traverse a barrier for emergency or safety purposes.

SUMMARY OF THE INVENTION

A portable step constructed in accordance with the invention comprises a tread member to which is connected a pair of elongate support members which terminate at their opposite ends in coupling projections which extend at an acute angle from the support members. The support members may be pivoted relative to the tread member so as to occupy substantially parallel positions in which the projections may be thrust through openings in a chain-link or other upright barrier or fence to enable the tread to be securely supported by the fence at a level between the upper and lower ends thereof.

The acute angle at which the projections extend from the supports enables the latter to bear directly against the fence, thereby providing an extremely stable face-to-face engagement between the fence and the supports.

To promote quietness in use, the supports may be enclosed in sound-deadening sleeves.

Two or more of the portable steps may be used in conjunction with one another and applied to a fence at different levels so as to facilitate a person's scaling the fence.

The pivotal coupling of the tread member to the support arms makes it possible to thrust the projections through openings in the fence even though such openings may not be at exactly the same level, thereby enabling the tread to be supported in a substantially horizontal position. The pivotal coupling also enables the support arms and the tread members to be compacted for transport and storage.

THE DRAWINGS

Apparatus constructed in accordance with the invention is disclosed in the accompanying drawing wherein:

FIG. 1 is a fragmentary, isometric view showing a number of portable steps attached to a fence in such manner as to facilitate the scaling of the fence by a person;

FIG. 2 is a front elevational view, with parts broken of the portable step in erected condition;

FIG. 3 is a top plan view with parts broken away;

FIG. 4 is a side elevational view; and

FIG. 5 is an elevational view showing the parts of the step in compacted condition.

THE PREFERRED EMBODIMENT

A portable step constructed in accordance with the preferred embodiment of the invention is designated generally by the reference character 1 and comprises an elongate tread member 2 formed of wood, metal, or any other suitable material. The upper surface of the tread member 2 preferably is covered with an anti-slip coating or material 3 of any conventional kind. One edge of the tread member is notched at 4 to accommodate a light reflective strip 5.

The step 1 includes a pair of uniform length supports 6 each of which comprises an elongate metal rod or arm 7 terminating at one end in an extension 8 pivotally journaled in an opening 9 that extends transversely of the tread member 2. The extension 8 has a free end 10 which projects slightly beyond the edge of the tread member 2 and is secured against withdrawal from the opening 9 by a washer 11 and a pin 12.

Each support arm 7 is joined at its opposite end to a coupling projection 13 which diverges from its juncture with support arm at an acute angle and in a direction opposite that in which the extensions 8 extend from the arm. The arm and its associated projection from a Vee and the inclined angle between the arm 7 and the projection 13 preferably is about 30°.

If desired, a sound-deadening sleeve 14 may encircle each of the support arms 7 between the extension 8 and the projection 13. The material from which the sleeve 14 is formed may be rubbery or rubber-like thus providing not only sound-deadening properties, but electrical insulation properties as well.

To condition the portable step for use, the supports 6 are pivoted relative to the tread member 2 to such positions that they extend in the same direction from the tread member and are substantially parallel, as is shown in FIG. 2. The step then may be secured to an upright barrier 15 such as a fence. As shown in FIG. 1, the barrier 15 comprises a chain-link fence occupying a vertical plane and having spaced apart links 16 which form openings 17 therebetween.

To apply the step to the barrier 15, the projection 13 of one of the arms 7 is thrust into one opening 17 of the barrier, whereas the projection of the other arm is thrust into another opening 17. The support arms 7 are not required to be parallel, thereby enabling extremely rapid coupling of the step to the barrier.

The height at which the projections 13 are thrust through the fence openings 17 should be such as to enable the tread member 2 to occupy a level convenient for a person to place his foot thereon to assist him in scaling the barrier. If the barrier is more than about six feet in height, two or more of the steps may be applied to the barrier as is shown in FIG. 1, thereby providing a number of successively higher level tread members by means of which a person easily may traverse the barrier.

The extension of the projections 13 from the respective support arms 7 at an acute angle to form a Vee having its apex at the parts 7 and 13 is a significant and important characteristic of the invention. The angular relationship not only minimizes the possibility of inadvertent disengagement of a projection 13 from the barrier, but also ensures flush or face-to-face engagement between the supports 6 and the links 16 of the fence. Thus, if the links of the fence are considered to form a vertical plane 18 (FIG. 4) the Vee projections 13 will ensure that virtually the full length of the support 6 will be flush with one side of the plane of the fence with the projections extending through the plane, thereby avoiding any relative movement of the tread member 2 toward and away from the plane of the fence when a person uses the step to scale the fence. There thus is provided an extremely stable, temporary support for the fence scaler.

The provision of the sleeves 14 reduces considerably the amount of noise that otherwise would be generated in attaching the step to the barrier.

Raids of premises frequently are conducted at night. However, there almost always is some light produced by street lamps, passing vehicles, or the like. Such light may be reflected by the reflector 5, thereby assisting officers in locating the step or steps 1 as they approach the barrier 15.

When the step is not in use, the respective support arms 7 may be rotated in the direction of the arrows 19 and 20 (FIG. 2) to enable them to occupy the positions shown in FIG. 5. The length of each of the members 7 is somewhat less than that of the tread member, thereby enabling the step to assume a compact position for storage or transport.

The disclosed embodiment is representative of a presently preferred form of the invention, but is intended to be illustrative rather than definitive thereof. The invention is defined in the claims.

We claim:

1. A portable step device for use in facilitating scaling an upright, substantially planar fence formed of wire and having openings therein, said device comprising a tread member having two sides; a pair of support members; means connecting corresponding ends of said support members to said tread member adjacent opposite ends thereof and in such manner that said support members occupy a position at the same side of said tread member and may extend therefrom in the same direction; and coupling means joined to each of said support members at its opposite end, each of said coupling means comprising a projection extending from its juncture with the associated support member at an acute angle thereto and in a direction away from said one side of tread member to form a Vee whose apex is at said juncture, each of said projections being of such size as freely and removably to be accommodated in an opening in said fence and a wire of said fence accommodated in said Vee, thereby to suspend said tread member from said fence and locate said support members flush against one side of said fence with said tread member in a substantially horizontal position at a level intermediate the height of said fence.

2. The device according to claim 1 wherein the corresponding ends of said support members are pivotally connected to said tread member thereby enabling rotation of said support members in a common plane adjacent said one side of said tread member, said tread member occupying a position at one side of said plane and said projections extending through said plane to the opposite side thereof.

3. The device according to claim 1 wherein said corresponding ends of said support members extend transversely of said tread member.

4. The device according to claim 3 wherein said corresponding ends of said support members extend through openings in said tread member.

5. The device according to claim 1 wherein each of said support members carries sound-deadening means.

6. The device according to claim 5 wherein said sound-deadening means comprises a sleeve formed of rubbery material.

7. The device according to claim 1 wherein said support members are of substantially uniform length.

8. The device according to claim 7 wherein the length of each of said support members is less than that of said tread member.

9. The device according to claim 1 wherein said corresponding ends of said support members are connected to said tread member adjacent opposite ends thereof.

10. A portable step device for use in facilitating scaling an upright barrier having a plurality of spaced apart openings therein, said device comprising a tread member having opposite sides; a pair of elongate support members; means rockably connecting said support members at corresponding ends thereof to said tread member, both of said support members being positioned at one side of said tread member; and a coupling projection joined to each of said support members at its opposite end, each of said coupling projections diverging from its juncture with its associated support member at an acute angle and in a direction away from said one side of said tread member to form with its support member a Vee having its apex at said juncture, each of said projections being of such size as freely to be accommodated in an opening of said barrier and suspend said tread member from said barrier with said one side of said tread member confronting said barrier and said support members flush against said barrier.

11. The device according to claim 10 wherein said corresponding ends of said support members extend transversely of said tread member from said one side thereof toward the opposite side.

12. The device according to claim 11 wherein said corresponding ends of said support members extend through openings in said tread member.

13. The device according to claim 10 wherein each of said support members carries sound-deadening means.

14. The device according to claim 13 wherein said sound-deadening means comprises a sleeve formed of rubbery material.

15. The device according to claim 10 including means forming a non-slip surface on said tread member.

16. The device according to claim 10 including light reflecting means carried by said tread member at least at one side thereof.

17. The device according to claim 10 wherein said support members are of substantially uniform length.

18. The device according to claim 17 wherein the length of each of said support members is less than that of said tread member.

19. The device according to claim 10 wherein said corresponding ends of said support members are connected to said tread member adjacent opposite ends thereof.

* * * * *